US009857711B2

(12) United States Patent
Yoshida et al.

(10) Patent No.: US 9,857,711 B2
(45) Date of Patent: Jan. 2, 2018

(54) TONER

(71) Applicant: CANON KABUSHIKI KAISHA, Tokyo (JP)

(72) Inventors: Yu Yoshida, Mishima (JP); Masashi Kawamura, Yokohama (JP); Yuhei Terui, Numazu (JP); Takayuki Toyoda, Yokohama (JP); Takeshi Sekiguchi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/149,817

(22) Filed: May 9, 2016

(65) Prior Publication Data

US 2016/0349646 A1 Dec. 1, 2016

(30) Foreign Application Priority Data

May 27, 2015 (JP) ..... 2015-107589

(51) Int. Cl.
*G03G 9/087* (2006.01)
*G03G 9/09* (2006.01)

(52) U.S. Cl.
CPC ..... *G03G 9/091* (2013.01)

(58) Field of Classification Search
CPC ..... G03G 9/09733; G03G 9/09758
See application file for complete search history.

(56) References Cited

U.S. PATENT DOCUMENTS

| | | | |
|---|---|---|---|
| 7,141,342 | B2 | 11/2006 | Toyoda et al. |
| 7,264,910 | B2 | 9/2007 | Toyoda et al. |
| 7,833,685 | B2 | 11/2010 | Tanaka et al. |
| 7,833,687 | B2 | 11/2010 | Kato et al. |
| 8,211,606 | B2 | 7/2012 | Murai et al. |
| 8,377,616 | B2 | 2/2013 | Tani et al. |
| 8,440,382 | B2 | 5/2013 | Isono et al. |
| 8,497,054 | B2 | 7/2013 | Sugiyama et al. |
| 8,628,899 | B2 | 1/2014 | Kawamura et al. |
| 8,652,725 | B2 | 2/2014 | Watanabe et al. |
| 8,652,737 | B2 | 2/2014 | Handa et al. |
| 8,697,327 | B2 | 4/2014 | Shibata et al. |
| 8,778,581 | B2 | 7/2014 | Nonaka et al. |
| 8,815,484 | B2 | 8/2014 | Tanaka et al. |
| 8,871,415 | B2 | 10/2014 | Nagasawa et al. |
| 8,916,319 | B2 | 12/2014 | Ikeda et al. |
| 8,916,323 | B2 | 12/2014 | Sugama et al. |
| 8,940,467 | B2 | 1/2015 | Hashimoto et al. |
| 9,069,273 | B2 | 6/2015 | Mori et al. |
| 9,069,274 | B2 | 9/2015 | Katsumoto et al. |
| 9,146,485 | B2 | 9/2015 | Tani et al. |
| 9,158,216 | B2 | 10/2015 | Shimano et al. |
| 9,170,513 | B2 | 10/2015 | Mori et al. |
| 9,229,345 | B2 | 1/2016 | Ikeda et al. |
| 9,323,168 | B2 | 4/2016 | Mori et al. |
| 2008/0299482 | A1 | 12/2008 | Kato et al. |
| 2010/0035171 | A1 | 2/2010 | Watanabe et al. |
| 2013/0280649 | A1* | 10/2013 | Nagasawa ..... G03G 9/09733 430/108.4 |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2015/0099220 | A1 | 4/2015 | Abe et al. |
| 2015/0099222 | A1 | 4/2015 | Terui et al. |
| 2015/0099224 | A1 | 4/2015 | Abe et al. |
| 2015/0153666 | A1 | 6/2015 | Isono et al. |
| 2015/0153667 | A1 | 6/2015 | Noji et al. |
| 2015/0153669 | A1 | 6/2015 | Yoshida et al. |
| 2015/0153670 | A1 | 6/2015 | Shimano et al. |
| 2015/0261110 | A1 | 9/2015 | Nakagawa et al. |
| 2015/0274853 | A1 | 10/2015 | Nishiura et al. |
| 2015/0277254 | A1 | 10/2015 | Mukumoto et al. |
| 2015/0370189 | A1 | 12/2015 | Tanaka et al. |
| 2015/0378273 | A1 | 12/2015 | Mori et al. |

FOREIGN PATENT DOCUMENTS

| | | | | |
|---|---|---|---|---|
| JP | 2013-137443 | A | 7/2013 | |
| JP | 2013-238840 | A | 11/2013 | |
| JP | 2013-242523 | A | 12/2013 | |
| JP | 2014-063156 | A | 4/2014 | |
| JP | 2015-064566 | A | 4/2015 | |
| WO | WO 2013/133449 | * | 9/2013 | ..... G03G 9/087 |

OTHER PUBLICATIONS

Koji Ishizu, "Synthesis of Novel Primary Amino-Terminated Polymer and Application for Macromonomer", Journal of Polymer Science Part A: Polymer Chemistry, vol. 28 (1990) 1887-94.

Toshiro Uchida, aet al., "Graft Copolymers Having Hydrophobic Backbone and Hydrophilic Branches. XXX. Preparation of Polystyrene-Core Nanospheres Having a Poly(2-methacryloyloxyethyl phosphorylcholine) Corona", Journal of Polymer Science Part A: Polymer Chemistry, vol. 38 (2000) 3052-58.

Marck Storen, "evaporation energies and molar vols. (25° C.) of atom and atomic group" in Table 3-9 of the book "Basic Science of Coating" (1986) 54-57.

* cited by examiner

*Primary Examiner* — Peter Vajda
(74) *Attorney, Agent, or Firm* — Fitzpatrick Cella Harper and Scinto

(57) ABSTRACT

Provided is a toner including toner particles each containing: a binder resin, a crystalline polyester, and a colorant, in which: the colorant includes a compound represented by the following formula (1); and the binder resin and the crystalline polyester satisfy the following formula (2):

Formula (1)

in the formula (1), $R^1$, $R^2$, and $R^3$ each independently represent a hydrogen atom or an alkyl group having 1 to 5 carbon atoms, and Ar represents an aryl group.

$\Delta SP = |SP1 - SP2| \leq 0.43$ Formula (2).

16 Claims, No Drawings

TONER

BACKGROUND OF THE INVENTION

Field of the Invention

The present invention relates to a toner to be used in image-forming methods, such as an electrophotographic method, an electrostatic recording method, and a toner jet method.

Description of the Related Art

Nowadays, power saving is required in a copying machine or a printer.

As a method of performing the power saving, there is known a method involving reducing the temperature of a toner at the time of its heat fixation in an electrophotographic process to curtail an electric power. A reduction in laid-on level of the toner on one sheet of paper is effective for that purpose, and the reduction in laid-on level requires an improvement in coloring power of the toner.

For example, a colorant (dye) having high solubility in a resin is used as a colorant for improving the coloring power of the toner.

The dye as the colorant of the toner has been utilized as effective means for improving the coloring power because the dye colors the entirety of a resin constituting the toner.

In Japanese Patent Application Laid-Open No. 2013-137443, there is a disclosure of an improvement in coloring power through the use of a dye. In general, however, the use of the dye involves a problem in that the light fastness of an image after its printing reduces.

In Japanese Patent Application Laid-Open No. 2014-63156, an improvement in light fastness is achieved by improving a dye. InJapanese Patent Application Laid-Open No. 2014-63156, there is a disclosure of a toner achieving both coloring power and light fastness as a result of the improvement.

SUMMARY OF THE INVENTION

In recent years, however, the achievement of both coloring power and light fastness at higher levels has been required. The inventors of the present invention have made an investigation, and as a result, have found that the toners described in Japanese Patent Application Laid-Open No. 2013-137443 and Japanese Patent Application Laid-Open No. 2014-63156 are each susceptible to improvement in terms of the achievement of both coloring power and light fastness. An object of the present invention is to provide a toner that can achieve both coloring power and light fastness at high levels.

According to one embodiment of the present invention, there is provided a toner containing a toner particle comprising:

a binder resin, a crystalline polyester, and a colorant, in which:

the colorant includes a compound represented by the following formula (1); and the binder resin and the crystalline polyester satisfy the following formula (2):

Formula (1)

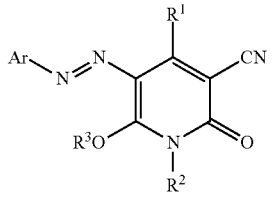

in the formula (1), $R^1$, $R^2$, and $R^3$ each independently represent a hydrogen atom or an alkyl group having 1 to 5 carbon atoms, and Ar represents a substituted or unsubstituted aryl group, or a substituted or unsubstituted heteroaryl group, $$\Delta SP = |SP1 - SP2| \leq 0.43 \quad \text{Formula (2)}$$

in the formula (2),

SP1 represents a solubility parameter of the binder resin according to the equation of Fedors, and SP2 represents a solubility parameter of the crystalline polyester according to the equation of Fedors.

Further features of the present invention will become apparent from the following description of exemplary embodiments.

DESCRIPTION OF THE EMBODIMENTS

An embodiment of the present invention is described in detail below.

The inventors of the present invention have made extensive investigations to solve the related-art problems. As a result, the inventors have found that a toner having the following characteristics exhibits high effects of coloring power and light fastness: the absolute value ($|SP1-SP2|=\Delta SP$) of a difference in SP value between a SP1 representing the solubility parameter of a binder resin and a SP2 representing the solubility parameter of a crystalline polyester falls within the range described in the present invention, and the toner contains a compound represented by the formula (1).

The use of the compound represented by the formula (1) having high coloring power is effective in improving the coloring power of the toner. A colorant having the compound represented by the formula (1) is a yellow colorant. One possible cause for the deterioration of the light fastness of an image after its printing is the decomposition of the compound due to absorption of light in an ultraviolet region. The crystalline polyester having high crystallinity has a high refractive index, and the absorption by a substance having a high refractive index in the ultraviolet region generally tends to be strong. In the case where the crystalline polyester that has crystallized is present in the toner in the image after its heat fixation, when the image is irradiated with light including UV light, such as sunlight, the crystalline polyester absorbs the UV light and hence a dye in the image may be protected. Accordingly, the light fastness is improved. In addition, a SP value is a parameter representing the compatibility of a substance, and as ΔSP which is the absolute value of a difference in SP value between substances becomes smaller, compatibility between the substances is improved. The use of the crystalline polyester having a small ΔSP from the binder resin may make the binder resin and the crystalline polyester satisfactorily compatible with each other at the time of the heat fixation of the toner. Accordingly, when the crystalline polyester recrystallizes in the image after the fixation, a crystal nucleus is formed in the state in which the binder resin and the crystalline polyester are uniformly compatible with each other, and hence the dispersibility of the crystalline polyester in the image is expected to be improved. When the dispersibility is improved, a wider range on the image can be protected from the UV light, and hence the effect of the light fastness may be able to be additionally exhibited.

Because of the foregoing reasons, in the toner of the present invention, the absolute value ΔSP(=|SP1−SP2|) of the difference between the solubility parameter SP1 of the binder resin and the solubility parameter SP2 of the crystalline polyester is 0.43 or less. When the ΔSP is 0.43 or less, the light fastness is improved because of the foregoing reasons. The ΔSP more preferably falls within the range of 0.30 or less. The ΔSP can be controlled by changing the monomer composition of each of the binder resin and the crystalline polyester.

<Colorant>

The colorant to be used in the present invention contains the compound represented by the formula (1). The use of the compound represented by the formula (1) can provide a high level of coloring power because the compound colors the entirety of the resins constituting the toner. A compound synthesized by a method to be described later can be used as the compound represented by the formula (1). In addition, a known colorant can be used.

Formula (1)

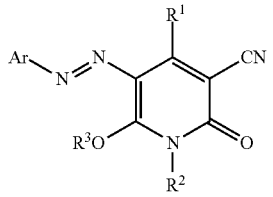

In the formula (1), $R^1$, $R^2$, and $R^3$ each independently represent a hydrogen atom or an alkyl group having 1 to 5 carbon atoms, and Ar represents a substituted or unsubstituted aryl group, or a substituted or unsubstituted heteroaryl group.

The alkyl group having 1 to 5 carbon atoms is a linear or branched alkyl group. Specific examples thereof include a methyl group, an ethyl group, a propyl group, an isopropyl group, a n-butyl group, an isobutyl group, a sec-butyl group, a tert-butyl group, a n-pentyl group, a 1-methylbutyl group, a 2-methylbutyl group, a 3-methylbutyl group, a 1,1-dimethylpropyl group, a 1,2-dimethylpropyl group, a 2,2-dimethylpropyl group, and a 3-pentyl group.

Examples of the aryl group include aromatic hydrocarbon groups, such as benzene, naphthalene, anthracene, phenanthrene, and pyrene. Examples of the heteroaryl group include heteroaromatic hydrocarbon groups, such as pyrrole, pyrazole, imidazole, oxazole, isooxazole, oxadiazole, thiazole, isothiazole, thiadiazole, pyridine, pyridazine, pyrimidine, pyrazine, triazine, furan, and thiophene. In addition, a group in which the aromatic hydrocarbon group and the heteroaromatic hydrocarbon group are condensed with each other may be included.

As a substituent of the substituted aryl group and a substituent of the substituted heteroaryl group, there can be given an alkyl group, an alkoxyl group, a carbonyl group, an alkoxycarbonyl group, an amide group, a sulfonic acid ester group, and a sulfonic acid amide group.

The compound represented by the formula (1) is preferably a compound represented by the following formula (3) out of those compounds. When the compound represented by the formula (3) is used, the light fastness tends to be improved with more ease.

Formula (3)

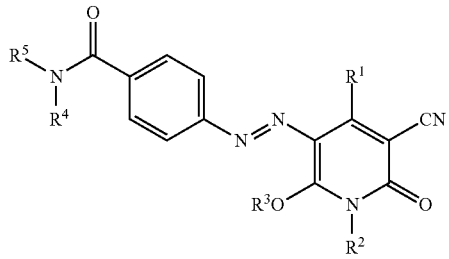

(In the formula (3), $R^1$, $R^2$, and $R^3$ each independently represent a hydrogen atom or an alkyl group having 1 to 5 carbon atoms, and $R^4$ and $R^5$ each independently represent a hydrogen atom or an alkyl group having 1 to 12 carbon atoms.)

The same alkyl group as the alkyl group defined as any one of $R^1$, $R^2$, and $R^3$ in the formula (1) can be used as the alkyl group having 1 to 5 carbon atoms represented by any one of $R^1$, $R^2$, and $R^3$ in the formula (3).

In the formula (3), the alkyl group having 1 to 12 carbon atoms represented by any one of $R^4$ and $R^5$ is a linear or branched alkyl group. Specific examples thereof include a methyl group, an ethyl group, a propyl group, an isopropyl group, a n-butyl group, an isobutyl group, a sec-butyl group, a tert-butyl group, a n-pentyl group, a 1-methylbutyl group, a 2-methylbutyl group, a 3-methylbutyl group, a 1,1-dimethylpropyl group, a 1,2-dimethylpropyl group, a 2,2-dimethylpropyl group, a 3-pentyl group, a n-hexyl group, a 1-methylpentyl group, a 2-methylpentyl group, a 3-methylpentyl group, a 4-methylpentyl group, a 1,1-dimethylbutyl group, a 1,2-dimethylbutyl group, a 1,3-dimethylbutyl group, a 2,2-dimethylbutyl group, a 2,3-dimethylbutyl group, a 3,3-dimethylbutyl group, a 3,3-dimethylbutan-2-yl group, a 2,3-dimethylbutan-2-yl group, a 3-hexyl group, a 2-ethylpentyl group, a 2-methylpentan-3-yl group, a heptyl group, an octyl group, a nonyl group, and a decyl group.

In addition, Solvent Yellow 162, Disperse Yellow 114 and 231, and the like can be used as the known colorant.

It is more preferred that the colorant containing the compound represented by the formula (1) further contain a yellow pigment because the light fastness is additionally improved. Particularly effective is the case where the colorant is used in combination with, for example, C.I. Pigment Yellow 74, 93, 120, 151, 155, 180, 185, or 213. One kind of those pigments may be used alone, or two or more kinds thereof may be used as a mixture. In addition, when the compound represented by the formula (1) and the yellow pigment are used in combination, the mass ratio (compound represented by the formula (1)/yellow pigment) of the compound represented by the formula (1) to the yellow pigment is preferably 7/93 or more and 65/35 or less. When the ratio is 7/93 or more, an effect of the compound represented by the formula (1) is easily exhibited, and hence the coloring power is easily improved. When the ratio is 65/35 or less, the pigment easily absorbs light and hence the quantity of light which the dye receives reduces. Accordingly, the light fastness is easily improved. The ratio is more preferably 10/90 or more and 60/40 or less.

In the toner of the present invention, the content of the compound represented by the formula (1) is preferably 0.5 mass % or more and 10.0 mass % or less with respect to the total amount of the binder resin and the crystalline polyester. When the content is 0.5 mass % or more, the effect of the compound represented by the formula (1) is easily exhibited, and hence the coloring power is easily improved. Meanwhile, when the content is 10.0 mass % or less, the light fastness is easily improved.

<Crystalline Polyester>

In one aspect of the present invention, the crystalline polyester is preferably a resin having a crystalline polyester moiety and an amorphous moiety.

The amorphous moiety is preferably a polystyrene, a polyester, or a polyurethane. The amorphous moiety is more preferably a resin having a polystyrene moiety. When the amorphous moiety has the polystyrene moiety, excessive coalescence of the molecules of the crystalline polyester in the fixed image can be prevented, and hence its dispersibility is improved. Accordingly, the light fastness is easily improved. The crystalline polyester having the polystyrene moiety can be produced by a known method, or can be produced by a method to be described later.

In addition, in another aspect of the present invention, the crystalline polyester is preferably a resin having a crystalline polyester moiety and an amorphous polyester moiety or an amorphous polyurethane moiety serving as an amorphous moiety. The light fastness is easily improved because of the same reason as that described above. The crystalline polyester having the amorphous polyester moiety or the amorphous polyurethane moiety can be produced by a known method.

The term "crystalline" of the crystalline polyester in the present invention means that the polyester does not show a stepwise change in endotherm but has a clear endothermic peak in the differential scanning calorimetry (DSC) of the toner.

When the crystalline polyester has a clear endothermic peak in the differential scanning calorimetry (DSC), the following aspect is also included in a crystalline resin: the polyester is a graft body or a block body having the crystalline polyester moiety and the amorphous moiety.

The crystalline polyester that can be used in the present invention can be produced by subjecting a diol and a dicarboxylic acid to condensation polymerization.

Examples of the dicarboxylic acid include alkane dicarboxylic acids (e.g. succinic acid, adipic acid, pimelic acid, suberic acid, azelaic acid, sebacic acid, decanedicarboxylic acid, dodecanedicarboxylic acid, octadecanedicarboxylic acid, decylsuccinic acid, dodecylsuccinic acid, and octadecylsuccinic acid), alkenedicarboxylic acids (e.g. maleic acid, fumaric acid, citraconic acid, mesaconic acid, dodecenylsuccinic acid, pentadecenylsuccinic acid, octadecenylsuccinic acid, and dimer acid), and aromatic dicarboxylic acids (e.g. phthalic acid, isophthalic acid, terephthalic acid, and naphthalenedicarboxylic acid). Those dicarboxylic acids may be used in the form of acid anhydride or alkyl ester.

Examples of the diol include alkylene glycols (e.g. ethylene glycol, 1,2-propyrene glycol, 1,3-propyrene glycol, 1,4-butanediol, 1,6-hexanediol, 1,7-heptanediol, 1,8-octanediol, 1,9-nonanediol, 1,10-decanediol, 1,12-dodecanediol, 1,14-tetradecanediol, neopentyl glycol, 2,2-diethyl-1,3-propanediol, 1,4-cyclohexanedimethanol, hydrogenated bisphenol A, and spiroglycol), alkylene glycol ethers (e.g. diethylene glycol, triethylene glycol, and dipropylene glycol), and bisphenols (e.g. bisphenol A, bisphenol F, bisphenol S, an adduct of bisphenol A with 2 mol of ethylene oxide, and an adduct of bisphenol A with 2.5 mol of propylene oxide).

With regard to each of a dicarboxylic acid component and a diol component, one kind can be used alone, or two or more kinds thereof can be used in combination.

Of the dicarboxylic acids and the diols, an alkane dicarboxylic acid and an alkylene glycol are preferably used for producing a polyester having high crystallinity. Accordingly, the crystalline polyester moiety of the crystalline polyester preferably has a structural unit represented by the formula (4). That is, the crystalline polyester moiety preferably has a unit derived from a divalent acid monomer represented by the following formula (5) and a unit derived from a dihydric alcohol monomer represented by the following formula (6).

Formula (4)

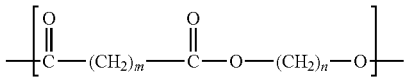

Formula (5)

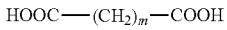

Formula (6)

(In the formulae (4) to (6), m represents an integer of from 4 to 10, and n represents an integer of from 4 to 12.)

When, in the formula (4), m represents 4 or more and n represents 4 or more, the degree of crystallinity of the crystalline polyester is increased, and hence the light fastness is easily improved. When, in the formula (4), m represents 10 or less and n represents 12 or less, the compatibility of the polyester with the binder resin is improved, and hence its dispersibility in the image after the fixation is improved. Accordingly, the light fastness is easily improved.

The crystalline polyester can be produced by a condensation polymerization reaction to be typically used. A known esterification catalyst, such as a tin compound or a titanium compound, may be used in the condensation polymerization reaction as required.

In addition, a terminal-sealing agent may be used in the crystalline polyester. The use of the terminal-sealing agent enables the adjustment of, for example, the molecular weight, acid value, hydroxyl value, and degree of crystallinity of the crystalline polyester. Examples of the terminal-sealing agent include a monovalent acid or a derivative thereof, and a monohydric alcohol.

Specific examples of the monovalent acid or the derivative thereof include acetic acid, propanoic acid, butanoic acid, pentanoic acid, hexanoic acid, heptanoic acid, octanoic acid, nonanoic acid, decanoic acid, lauric acid, stearic acid, benzoic acid, and acid anhydrides thereof.

Examples of the monohydric alcohol include methanol, ethanol, propanol, butanol, pentanol, hexanol, heptanol, octanol, nonanol, decanol, lauryl alcohol, and stearyl alcohol.

When the crystalline polyester is a resin having the crystalline polyester moiety and an amorphous polystyrene moiety, a styrene-based polymerizable monomer capable of radical polymerization can be used as a polymerizable monomer constituting the amorphous polystyrene moiety.

Examples of the styrene-based polymerizable monomer include, as monofunctional polymerizable monomers, styrene, and styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene, and as polyfunctional polymerizable monomers, divinylbenzene and divinylnaphthalene.

One kind of the monofunctional polymerizable monomers can be used alone, or two or more kinds thereof can be used in combination. Alternatively, the monofunctional polymerizable monomer and the polyfunctional polymerizable monomer can be used in combination. Alternatively, one kind of the polyfunctional polymerizable monomers can be used alone, or two or more kinds thereof can be used in combination.

The mass ratio (crystalline polyester moiety/amorphous moiety) of the crystalline polyester moiety to the amorphous moiety in the crystalline polyester is preferably 50/50 or more and 95/5 or less. When the ratio is 50/50 or more, the degree of crystallinity of the crystalline polyester is increased, and hence the light fastness is easily improved. When the ratio is 95/5 or less, the polyester becomes easily compatible with the binder resin, and hence its dispersibility in the image is improved. Accordingly, the light fastness is easily improved.

In addition, the crystalline polyester is preferably a block polymer having the crystalline polyester moiety and the amorphous polystyrene moiety. When the toner has the block polymer, a microdomain is easily formed after its heat fixation, and hence the light fastness is easily improved. The block polymer can be produced by a method to be described later.

Here, the "block polymer" in the present invention refers to a polymer including a plurality of linearly linked block structures. The polymer refers to a polymer having one or several kinds of block structures bonded as side chains to a main chain therein.

The crystalline polyester having the amorphous polystyrene moiety can be produced by subjecting a vinyl polymer block having a carboxylic acid or a carboxylate at a terminal thereof, a diol, and a dicarboxylic acid to condensation polymerization. The vinyl polymer block having a carboxylic acid or a carboxylate at a terminal thereof can be introduced by a known method. A method involving using a functional group-containing initiator is described in, for example, Koji Ishizu, "Journal of Polymer Science Part A: Polymer Chemistry", (United States), John Wiley & Sons, 1990, Vol. 28, pp. 1887-1894. A method involving using a functional group-containing chain transfer agent is described in, for example, Toshiro Uchida, and four other persons, "Journal of Polymer Science Part A: Polymer Chemistry", (United States), John Wiley & Sons, 2000, Vol. 38, pp. 3052-3058.

In addition, in the crystalline polyester, the amorphous moiety may be a resin having an amorphous polyester moiety obtained by subjecting a dicarboxylic acid and a diol to condensation polymerization, or an amorphous polyurethane moiety obtained by subjecting a diisocyanate and a diol to condensation polymerization. The following compounds can be used as the dicarboxylic acid, the diisocyanate, and the diol constituting the amorphous polyester moiety or the amorphous polyurethane moiety.

Examples of the dicarboxylic acid include oxalic acid, malonic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, hexahydroterephthalic acid, phthalic acid, isophthalic acid, terephthalic acid, tetrachlorophthalic acid, chlorophthalic acid, nitrophthalic acid, p-carboxyphenylacetic acid, p-phenylene diacetic acid, m-phenylene diglycolic acid, p-phenylene diglycolic acid, o-phenylene diglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and cyclohexane dicarboxylic acid.

Examples of the diisocyanate include 4,4'-diphenylmethane diisocyanate (MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, and polymethylene polyphenyl isocyanate (PAPI). Of those, 4,4'-diphenylmethane diisocyanate (MDI) is preferred.

Examples of the diol include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol A, a bisphenol A-ethylene oxide adduct, a bisphenol A-propylene oxide adduct, hydrogenated bisphenol A, a hydrogenated bisphenol A-ethylene oxide adduct, and a hydrogenated bisphenol A-propylene oxide adduct.

Those dicarboxylic acids, diisocyanates, and diols each can be used alone, or two or more kinds thereof can be used in combination.

In addition, in each of the combinations of the dicarboxylic acid and the diisocyanate, and the dicarboxylic acid and the diol, one, or each of both, of the compounds is preferably an aromatic compound. The use of the aromatic compound enables the crystalline polyester to absorb UV light, and hence can protect the compound represented by the formula (1) at the time of the production of the toner.

The weight-average molecular weight (Mw) of the crystalline polyester according to the present invention is preferably 10,000 or more and 50,000 or less. When the weight-average molecular weight is 10,000 or more, the crystallinity is easily improved and hence the light fastness is easily improved. When the weight-average molecular weight is 50,000 or less, the polyester becomes easily compatible with the binder resin, and hence its dispersibility in the image is improved. Accordingly, the light fastness is easily improved. The Mw of the crystalline polyester can be controlled by changing a reaction time, a reaction temperature, or a monomer loading ratio at the time of its production.

The melting point of the crystalline polyester according to the present invention is preferably 50° C. or more and 90° C. or less. When the melting point of the crystalline polyester is 50° C. or more, the degree of crystallinity of the crystalline polyester tends to be easily increased, and hence the light fastness is easily improved. When the melting point is 90° C. or less, the polyester easily melts at the time of the heat fixation, and hence its compatibility is improved and its dispersibility in the image is also improved. Accordingly, the light fastness is easily improved. The melting point more preferably falls within the range of from 55° C. or more to 85° C. or less. The melting point of the crystalline polyester can be controlled by changing its monomer composition.

In the toner of the present invention, the content of the crystalline polyester is preferably 0.5 mass % or more and 30 mass % or less with respect to the total amount of the binder resin and the crystalline polyester. When the content of the crystalline polyester is 0.5 mass % or more with respect to the total amount of the binder resin and the crystalline polyester, the amount of the polyester enough to exhibit the effect of the light fastness is secured, and hence the light fastness is easily improved. When the content is 30 mass % or less, the dispersibility of the polyester after the fixation is easily maintained, and hence the light fastness is easily improved. The content is more preferably 3 mass % or more and 20 mass % or less.

<Binder Resin>

Examples of the binder resin to be used in the toner of the present invention include known resins, such as a styrene vinyl resin, a maleic acid copolymer, a polyester resin, an epoxy resin, and a polyurethane resin.

When the crystalline polyester is the resin having the crystalline polyester moiety and the amorphous polystyrene moiety, the binder resin is preferably the styrene vinyl resin. When the binder resin is the styrene vinyl resin, its adaptability to the polystyrene moiety of the crystalline polyester is improved, and hence the dispersibility in the image is improved. Accordingly, the light fastness is easily improved.

The styrene vinyl resin is a resin obtained by polymerizing a styrene-based polymerizable monomer and a vinyl-based polymerizable monomer, and polymerizable monomers capable of radical polymerization can be used as these polymerizable monomers constituting the resin. Examples of the polymerizable monomers capable of radical polymerization include the following monofunctional polymerizable monomers and polyfunctional polymerizable monomers.

Examples of the monofunctional polymerizable monomers include: styrene-based polymerizable monomers, such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; and methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

Examples of the polyfunctional polymerizable monomers include, diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

One kind of the monofunctional polymerizable monomers can be used alone, or two or more kinds thereof can be used in combination. Alternatively, the monofunctional polymerizable monomer and the polyfunctional polymerizable monomer can be used in combination. Alternatively, one kind of the polyfunctional polymerizable monomers can be used alone, or two or more kinds thereof can be used in combination.

The ratio of the styrene-based polymerizable monomer in the styrene vinyl resin to be used as the binder resin of the present invention is preferably about 10% or more, more preferably 50% or more in terms of a mass ratio with respect to the total of the styrene-based polymerizable monomer and the other polymerizable monomer.

In addition, when the crystalline polyester is the resin having the crystalline polyester moiety and the amorphous polyester moiety or the amorphous polyurethane moiety, the binder resin is preferably an amorphous polyester resin. When the binder resin is the amorphous polyester resin, its adaptability to the polyester moiety of the crystalline polyester is improved, and hence the dispersibility in the image is improved. Accordingly, the light fastness is easily improved.

A polycarboxylic acid and a polyol can be used as condensation-polymerizable monomers that can be used in the polyester resin serving as the binder resin.

Examples of the polycarboxylic acid include oxalic acid, glutaric acid, succinic acid, maleic acid, adipic acid, β-methyladipic acid, malonic acid, pimelic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, hexahydroterephthalic acid, phthalic acid, isophthalic acid, terephthalic acid, tetrachlorophthalic acid, chlorophthalic acid, nitrophthalic acid, p-carboxyphenyl acetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid. In addition, examples of the polycarboxylic acid other than the dicarboxylic acids include trimellitic acid, pyromellitic acid, naphthalene tricarboxylic acid, naphthalene tetracarboxylic acid, pyrene tricarboxylic acid, and pyrene tetracarboxylic acid.

Examples of the polyol include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethyl benzene, bisphenol A, a bisphenol A-ethylene oxide adduct, a bisphenol A-propylene oxide adduct, hydrogenated bisphenol A, a hydrogenated bisphenol A-ethylene oxide adduct, and a hydrogenated bisphenol A-propylene oxide adduct.

In the present invention, any production method may be used as a production method for the production of toner particles. For example, the following methods can each be used: a suspension polymerization method involving suspending the polymerizable monomers for producing the binder resin, and a solution of the colorant, a release agent, and the like in an aqueous solvent, and polymerizing the suspension; a kneading pulverization method involving kneading, pulverizing, and classifying various toner constituent materials; an emulsion aggregation method involving mixing a dispersion liquid obtained by emulsifying and dispersing the binder resin, and a dispersion liquid of the colorant, the release agent, and the like, and aggregating and thermally fusing particles in the mixture to provide the toner particles; an emulsification polymerization aggregation method involving subjecting the polymerizable monomers for the binder resin to emulsion polymerization to form a dispersion liquid, mixing the liquid and a dispersion liquid of the colorant, the release agent, and the like as required, and aggregating and thermally fusing particles in the mixture to provide the toner particles; and a dissolution suspension method involving suspending the binder resin, and a solution of the colorant, the release agent, and the like in an aqueous solvent, and granulating the suspension.

Methods of measuring various physical properties according to the present invention are described below.

<Method of Calculating SP Value>

A SP value (δi) in the present invention is determined by using the equation of Fedors represented by the formula (7). Values for Δei and Δvi herein were determined with reference to the column "evaporation energies and molar volumes (25° C.) of atom and atomic group" in Table 3-9 of the book "Basic Science of Coating", p. 54 to 57, 1986 (Maki Shoten).

$$\delta i=[Ev/V]^{1/2}=[\Delta ei/\Delta vi]^{1/2} \quad \text{Formula (7)}$$

Ev: evaporation energy

V: molar volume

Δei: evaporation energy of an atom or an atomic group of i component

Δvi: molar volume of an atom or an atomic group of i component

For example, hexanediol is formed of an atomic group (—OH)×2+(—$CH_2$)×6, and its calculated SP value (δi) is determined by the following formula.

$$\delta i=[\Delta ei/\Delta vi]^{1/2}=[\{(5{,}220)\times 2+(1{,}180)\times 6\}/\{(13)\times 2+(16.1)\times 6\}]^{1/2}$$

Thus, hexanediol has a SP value (δi) of 11.95.

<Separation of Crystalline Polyester from Toner>

The toner is dissolved in tetrahydrofuran (THF), and the solvent is removed from the resultant soluble matter by distillation under reduced pressure. Thus, the tetrahydrofuran (THF)-soluble component of the toner is obtained.

A sample solution having a concentration of 25 mg/ml is prepared by dissolving the resultant tetrahydrofuran (THF)-soluble component of the toner in chloroform.

3.5 Milliliters of the resultant sample solution is poured into the following apparatus, and a low-molecular weight component derived from a wax, the component having a molecular weight of less than 2,000, and a high-molecular weight component derived from the binder resin and the crystalline polyester, the component having a molecular weight of 2,000 or more, are fractionated under the following conditions.

Preparative GPC apparatus: preparative HPLC Model LC-980 manufactured by Japan Analytical Industry Co., Ltd.

Columns for fractionation: JAIGEL 3H and JAIGEL 5H (manufactured by Japan Analytical Industry Co., Ltd.)

Eluent: chloroform

Flow rate: 3.5 ml/min

After the high-molecular weight component derived from the binder resin and the crystalline polyester has been fractionated, the solvent is removed by distillation under reduced pressure, and the residue is dried in an atmosphere at 90° C. under reduced pressure for 24 hours. The foregoing operation is repeated until about 100 mg of the binder resin and crystalline polyester components are obtained.

500 Milliliters of acetone is added to 100 mg of the binder resin and the crystalline polyester obtained by the operation, and the binder resin and the crystalline polyester are completely dissolved by heating the mixture to 70° C. After that, the crystalline polyester is recrystallized by gradually cooling the solution to 25° C. The resultant mixture is separated into the crystalline polyester and a filtrate by sucking and filtering the crystalline polyester.

<Method of Measuring Molecular Weight>

The weight-average molecular weight (Mw) and number-average molecular weight (Mn) of each of the binder resin and the crystalline polyester are measured by using gel permeation chromatography (GPC) as described below.

First, the binder resin or the crystalline polyester is dissolved in tetrahydrofuran (THF) at room temperature.

Then, the resultant solution is filtered with a solvent-resistant membrane filter "MyShoriDisk" (manufactured by Tosoh Corporation) having a pore diameter of 0.2 μm to provide a sample solution. The concentration of a THF-soluble component in the sample solution is adjusted to 0.8 mass %. Measurement is performed with the sample solution under the following conditions.

Apparatus: high-speed GPC apparatus "HLC-8220 GPC" [manufactured by Tosoh Corporation]

Column: twin of LF-604 [manufactured by Showa Denko K.K.]

Eluent: THF

Flow rate: 0.6 ml/min

Oven temperature: 40° C.

Sample injection amount: 0.020 ml

In the calculation of the molecular weight of a sample, a molecular weight calibration curve prepared with standard polystyrene resins (such as product names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used.

<Method of Measuring Ratio of Polyester Moiety to Amorphous Moiety in Crystalline Polyester on Mass Basis, and Measurement of Content of Crystalline Polyester in Toner>

The mass ratio of the polyester moiety to the amorphous moiety in the crystalline polyester is measured by using nuclear magnetic resonance spectroscopy ($^1$H-NMR) [400 MHz, $CDCl_3$, room temperature (25° C.)]. In addition, the content of the crystalline polyester is calculated from the integrated value of the nuclear magnetic resonance spectroscopy ($^1$H-NMR) spectrum of the toner based on the respective nuclear magnetic resonance spectroscopy ($^1$H-NMR) spectra of the binder resin and the crystalline polyester.

Measuring apparatus: FT NMR apparatus JNM-EX400 (manufactured by JEOL Ltd.)

Measuring frequency: 400 MHz

Pulse condition: 5.0 μs

Frequency range: 10,500 Hz

Cumulated number: 64 times

The mass ratio of the polyester moiety to the amorphous moiety is calculated from the resultant integrated value of the spectrum.

<Method of Measuring Melting Point (Tm)>

The melting point (Tm) of the crystalline polyester or the like is measured with a differential scanning calorimeter "Q1000" (manufactured by TA Instruments) in conformity with ASTM D3418-82.

The melting points of indium and zinc are used in the temperature correction of the detecting portion of the apparatus, and the heat of fusion of indium is used in the correction of a heat quantity.

Specifically, 5 mg of the sample is precisely weighed and loaded into a pan made of aluminum. The measurement is performed by using an empty pan made of aluminum as a reference in the measurement temperature range of from 0° C. or more to 150° C. or less at a rate of temperature increase of 10° C./min. In the measurement, the temperature of the sample is increased to 150° C. once at a rate of temperature increase of 10° C./min, is subsequently decreased to 0° C. at a rate of temperature decrease of 10° C./min, and is then increased again. The peak temperature of the highest endothermic peak of a DSC curve in the temperature range of from 0° C. or more to 150° C. or less in the second temperature increase process is defined as the melting point (Tm).

The present invention is described in more detail below by way of Examples, but the present invention is not limited to Examples described below. The present invention is described in detail below by way of Examples. Production methods for the colorant, crystalline polyester, and toner are described. The number of parts and % in Examples and Comparative Examples are all values on a mass basis unless otherwise specified.

<Synthesis of Colorant 1>

The present invention is described in more detail below by way of Examples and Comparative Examples, but the present invention is not limited to these Examples. In the following description, the expressions "part(s)" and "%" are by mass unless otherwise specified. The resultant reaction product was identified by an analysis method involving using a MALDI MS (autoflex apparatus, manufactured by Bruker Daltonics K.K.). A negative mode was adopted as a detection ion in the MALDI MS.

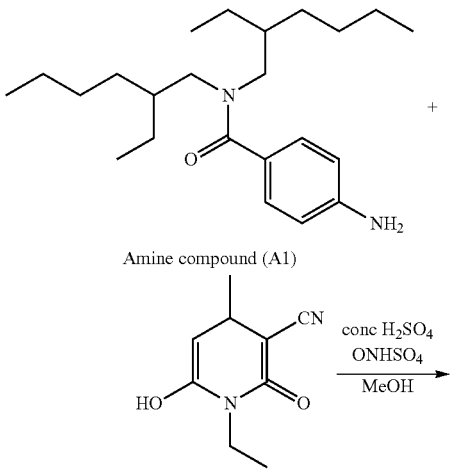

Amine compound (A1)

Pyridone compound (P1)

-continued

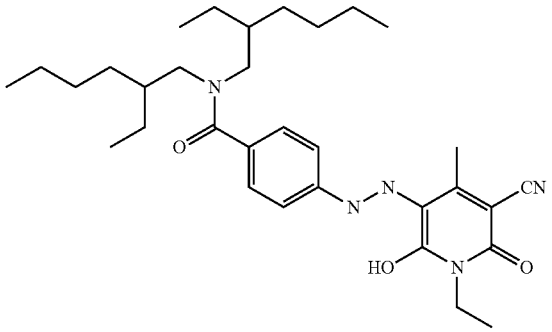

Colorant (S1)

In accordance with the foregoing scheme, a solution of 0.721 g of an amine compound (A1) in 20 mL of methanol (MeOH) was cooled to 5° C., and 2 mL of concentrated sulfuric acid and 1.4 mL of nitrosylsulfuric acid (40 mass %) were dropped to the solution. Thus, a diazotized A liquid was prepared. In addition, separately, a solution of 0.496 g of a pyridone compound (P1) in 20 mL of methanol (MeOH) was cooled to 5° C., and the diazotized A liquid was slowly dropped thereto so that the temperature was held at 5° C. or less, followed by stirring in an ice bath for 20 minutes. After the completion of the reaction, an aqueous solution of sodium carbonate was dropped to the resultant to neutralize its pH to 6, and then the neutralized product was extracted with chloroform. After that, the solvent was removed by distillation, and the resultant solid was purified by column chromatography (developing solvent: heptane/ethyl acetate) and recrystallized with a heptane solution to provide 0.8 g of a colorant 1 having a structure represented by S1 in the formula.

The resultant colorant 1 was identified by an analysis method involving using a MALDI MS (autoflex apparatus, manufactured by Bruker Daltonics K.K.). A negative mode was adopted as a detection ion in the MALDI MS.

Mass spectrometry with the MALDI MS:

m/z=618.612 $(M-H)^-$

<Synthesis of Colorant 2>

A colorant 2 having a structure represented by S2 was obtained in the same manner as in the colorant 1 except that the pyridone compound (P1) was changed to a pyridone compound (P2).

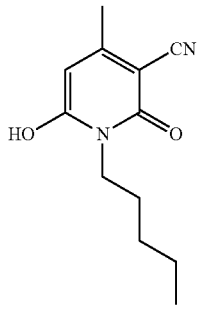

Pyridone compound (P2)

-continued

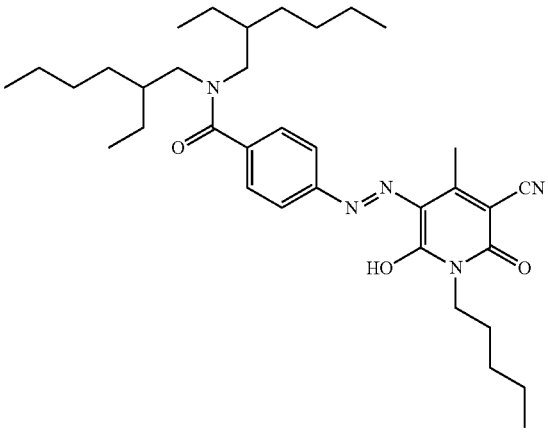

Colorant (S2)

<Synthesis of Colorant 3>

A colorant 3 having a structure represented by S3 was obtained in the same manner as in the colorant 1 except that: the amine compound (A1) was changed to an amine compound (A3); and the pyridone compound (P1) was changed to a pyridone compound (P3).

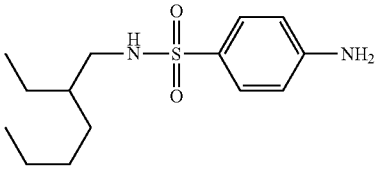

Amine compound (A3)

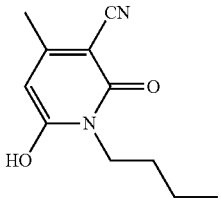

Pyridone compound (P3)

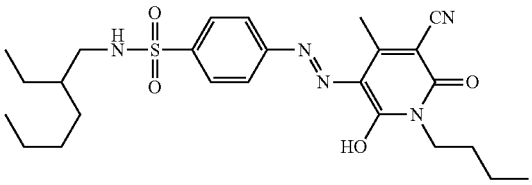

Colorant (S3)

<Synthesis of Colorant 4>

A colorant 4 having a structure represented by S4 was obtained in the same manner as in the colorant 1 except that: the amine compound (A1) was changed to an amine compound (A4); and the pyridone compound (P1) was changed to a pyridone compound (P4).

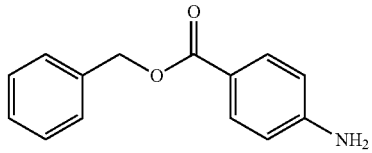

Amine compound (A4)

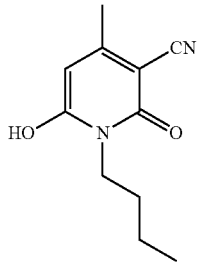

Pyridone compound (P4)

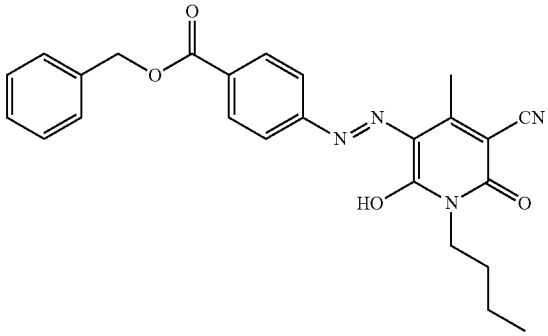

Colorant (S4)

<Synthesis of Colorant 5>

A colorant 5 having a structure represented by S5 was obtained in the same manner as in the colorant 1 except that: the amine compound (A1) was changed to an amine compound (A5); and the pyridone compound (P1) was changed to a pyridone compound (P5).

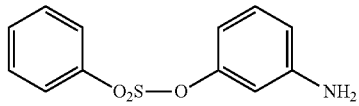

Amine compound (A5)

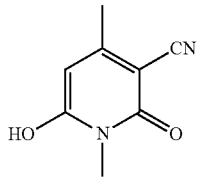

Pyridone compound (P5)

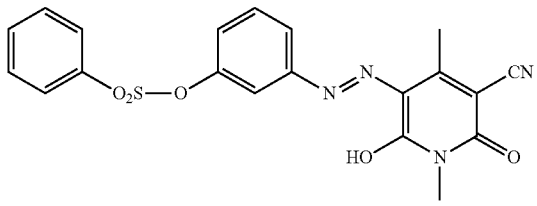

Colorant (S5)

<Production of Crystalline Polyester 1>

In a reaction vessel with a stirring machine, a temperature gauge, a nitrogen-introducing tube, and a decompression apparatus, 100.0 parts of xylene was heated while air in the vessel was replaced with nitrogen, and then the solution was refluxed at a liquid temperature of 140° C. A mixture of 100.0 parts of styrene and 6.0 parts of dimethyl 2,2'-azobis (2-methylpropionate) was dropped to the solution over 3 hours. After the completion of the dropping, the resultant solution was stirred for 3 hours. After that, xylene and the remaining styrene were removed by distillation at 160° C. and 1 hPa. Thus, a polystyrene (1) was obtained.

Next, 100.0 parts of the polystyrene (1) obtained in the foregoing, 88.0 parts of xylene serving as an organic solvent, 128.2 parts of 1,12-dodecanediol, and 0.43 part of titanium (IV) isopropoxide serving as an esterification catalyst were loaded into a reaction vessel with a stirring machine, a temperature gauge, a nitrogen-introducing tube, a dewatering conduit, and a decompression apparatus, and the mixture was subjected to a reaction under a nitrogen atmosphere at 150° C. for 4 hours. After that, 117.0 parts of sebacic acid was added to the resultant, and the mixture was subjected to a reaction at 150° C. for 3 hours and at 180° C. for 4 hours. After that, the resultant was further subjected to a reaction at 180° C. and 1 hPa until a desired weight-average molecular weight (Mw) was obtained. Thus, a crystalline polyester 1 was obtained. The physical properties of the resultant crystalline polyester 1 are shown in Table 3.

<Production of Crystalline Polyesters 2, 4 to 15, 17, and 24>

Crystalline polyesters were obtained in the same manner as in the production of the crystalline polyester 1 except that the raw materials were changed as shown in Table 1. The physical properties of the resultant crystalline polyesters are shown in Table 3.

<Production of Crystalline Polyester 3>

130.0 Parts of sebacic acid and 113.0 parts of 1,9-nonanediol were added to a reaction vessel with a stirring machine, a temperature gauge, a nitrogen-introducing tube, a dewatering conduit, and a decompression apparatus, and the mixture was heated to a temperature of 130° C. while being stirred. After 0.7 part of titanium(IV) isopropoxide had been added as an esterification catalyst to the mixture, the temperature of the mixture was increased to 160° C. and the mixture was subjected to condensation polymerization over 5 hours. After that, the temperature of the resultant was increased to 180° C., and the resultant was subjected to a reaction while a pressure in the vessel was reduced until a desired molecular weight was obtained. Thus, a crystalline polyester 3 was obtained. The physical properties of the resultant crystalline polyester 3 are shown in Table 3.

<Production of Crystalline Polyester 16>

100.0 Parts of sebacic acid and 93.5 parts of 1,12-dodecanediol were added to a reaction vessel with a stirring machine, a temperature gauge, a nitrogen-introducing tube, a dewatering conduit, and a decompression apparatus, and the mixture was heated to a temperature of 130° C. while being stirred. After 0.7 part of titanium(IV) isopropoxide had been added to the mixture, the temperature of the mixture was increased to 160° C. and the mixture was subjected to condensation polymerization over 5 hours. 15.0 Parts of acrylic acid and 140.0 parts of styrene were dropped to the resultant over 1 hour. The mixture was continuously stirred for 1 hour while its temperature was held at 160° C. After that, the monomer of a styrene-based resin component was removed at 8.3 kPa for 1 hour. After that, the temperature of the residue was increased to 210° C. and the residue was subjected to a reaction until a desired molecular weight was obtained. Thus, a crystalline polyester 16 was obtained. The physical properties of the resultant crystalline polyester 16 are shown in Table 3.

<Production of Crystalline Polyester 18>

Production of Amorphous Polyester A

6 Parts of a bisphenol A-ethylene oxide (BPA-EO), 58 parts of a bisphenol A-propylene oxide (BPA-PO), 36 parts of terephthalic acid (TPA), and 0.7 part of titanium(IV) isopropoxide were loaded into a reaction vessel with a stirring machine, a temperature gauge, a nitrogen-introducing tube, a dewatering conduit, and a decompression apparatus. After that, a nitrogen gas was introduced into the vessel to keep an atmosphere in the vessel inert, and a temperature in the vessel was increased. After that, the mixture was subjected to a reaction at 200° C. for from 12 hours to 20 hours. After that, a pressure in the vessel was gradually reduced at 230° C. and the resultant was subjected to a reaction until a desired molecular weight was obtained. Thus, an amorphous polyester A was synthesized.

Production of Crystalline Polyester B 133.0 Parts of 1,10-decanedicarboxylic acid and 111.0 parts of 1,10-decanediol were added to a reaction vessel with a stirring machine, a temperature gauge, a nitrogen-introducing tube, a dewatering conduit, and a decompression apparatus, and the mixture was heated to a temperature of 130° C. while being stirred. After 0.7 part of titanium(IV) isopropoxide had been added as an esterification catalyst to the mixture, the temperature of the mixture was increased to 160° C. and the mixture was subjected to a reaction while a pressure in the vessel was reduced until a desired molecular weight was obtained. Thus, a crystalline polyester B was synthesized.

Production of Crystalline Polyester 18

30 Parts of the amorphous polyester A and 70 parts of the crystalline polyester B were loaded into a reaction vessel with a stirring machine, a temperature gauge, a nitrogen-introducing tube, a dewatering conduit, and a decompression apparatus. After that, 0.7 part of titanium(IV) isopropoxide was loaded into the vessel, a nitrogen gas was introduced into the vessel to keep an atmosphere in the vessel inert, and a temperature in the vessel was increased. After that, the mixture was subjected to a co-condensation polymerization reaction at 215° C. for 5 hours. After that, the temperature was gradually increased to 230° C. and the resultant was stirred for 2 hours to synthesize a crystalline polyester 18. The physical properties of the resultant crystalline polyester 18 are shown in Table 3.

<Production of Crystalline Polyesters 20 to 23>

Crystalline polyesters were obtained in the same manner as in the production of the crystalline polyester 1 except that the raw materials were changed as shown in Table 2. The physical properties of the resultant crystalline polyesters are shown in Table 3.

<Production of Crystalline Polyester 19>

Production of Crystalline Polyester C 100.0 Parts of 1,10-decanedicarboxylic acid and 120.0 parts of 1,10-decanediol were added to a reaction vessel with a stirring machine, a temperature gauge, a nitrogen-introducing tube, a dewatering conduit, and a decompression apparatus, and the mixture was heated to a temperature of 130° C. while being stirred. After 0.7 part of titanium(IV) isopropoxide had been added as an esterification catalyst to the mixture, the temperature of the mixture was increased to 160° C. and the mixture was subjected to a reaction while a pressure in the vessel was reduced until a desired molecular weight was obtained. Thus, a crystalline polyester C was synthesized.

Production of Amorphous Polyurethane D

235 Parts of an adduct of bisphenol A with 2 mol of propylene oxide, 10 parts of ethylene glycol, 254 parts of 4,4'-diphenylmethane diisocyanate, and 400 parts of methyl ethyl ketone (MEK) were loaded into a reaction vessel with a condenser, a stirring machine, and a nitrogen-introducing tube, and were subjected to a reaction at 85° C. for 4 hours to synthesize an amorphous polyurethane D.

Production of Crystalline Polyester 19

105 Parts of the crystalline polyester C, 72 parts of the amorphous polyurethane D, and 400 parts of ethyl acetate were loaded into a reaction vessel with a stirring machine, a temperature gauge, a nitrogen-introducing tube, and a decompression apparatus, and were subjected to a reaction under normal pressure at 80° C. for κ hours, followed by the removal of the solvent. Thus, a crystalline polyester 19 was obtained. The physical properties of the resultant crystalline polyester 19 are shown in Table 3.

TABLE 2

| Crystalline polyester | Crystalline moiety | Part(s) by mass | Amorphous moiety | Part(s) by mass |
|---|---|---|---|---|
| Crystalline polyester 18 | Crystalline polyester B | 70 | Amorphous polyester A | 30 |
| Crystalline polyester 19 | Crystalline polyester C | 105 | Amorphous polyurethane D | 72 |
| Crystalline polyester 20 | Crystalline polyester B | 70 | Amorphous polyester A | 30 |
| Crystalline polyester 21 | Crystalline polyester B | 70 | Amorphous polyester A | 30 |
| Crystalline polyester 22 | Crystalline polyester B | 40 | Amorphous polyester A | 60 |
| Crystalline polyester 23 | Crystalline polyester B | 90 | Amorphous polyester A | 10 |

TABLE 1

| | Polyester moiety | | | | Polystyrene moiety | | Ratio "polyester |
|---|---|---|---|---|---|---|---|
| Crystalline polyester | Acid monomer | Part(s) by mass | Alcohol monomer | Part (s) by mass | Monomer | Part (s) by mass | moiety:polystyrene moiety" |
| Crystalline polyester 1 | Sebacic acid | 117.0 | 1,12-Dodecanediol | 128.2 | Styrene | 100.0 | 70:30 |
| Crystalline polyester 2 | 1,10-Decanedicarboxylic acid | 124.0 | 1,12-Dodecanediol | 120.0 | Styrene | 100.0 | 70:30 |
| Crystalline polyester 3 | Sebacic acid | 130.0 | 1,9-Nonanediol | 113.0 | — | — | — |
| Crystalline polyester 4 | Sebacic acid | 147.0 | 1,6-Hexanediol | 95.0 | Styrene | 100.0 | 69:31 |
| Crystalline polyester 5 | Suberic acid | 139.0 | 1,6-Hexanediol | 104.0 | Styrene | 100.0 | 69:31 |
| Crystalline polyester 6 | 1,10-Decanedicarboxylic acid | 133.0 | 1,10-Decanediol | 111.0 | Styrene | 100.0 | 69:31 |
| Crystalline polyester 7 | 1,12-Dodecanedicarboxylic acid | 131.0 | 1,12-Dodecanediol | 113.0 | Styrene | 100.0 | 70:30 |
| Crystalline polyester 8 | Sebacic acid | 117.0 | 1,12-Dodecanediol | 140.0 | Styrene | 100.0 | 70:30 |
| Crystalline polyester 9 | Sebacic acid | 117.0 | 1,12-Dodecanediol | 128.0 | Styrene | 100.0 | 70:30 |
| Crystalline polyester 10 | Sebacic acid | 117.0 | 1,12-Dodecanediol | 146.0 | Styrene | 100.0 | 70:30 |
| Crystalline polyester 11 | Sebacic acid | 116.0 | 1,12-Dodecanediol | 122.0 | Styrene | 100.0 | 70:30 |
| Crystalline polyester 12 | Sebacic acid | 64.0 | 1,12-Dodecanediol | 70.0 | Styrene | 100.0 | 55:45 |
| Crystalline polyester 13 | Sebacic acid | 283.0 | 1,12-Dodecanediol | 312.0 | Styrene | 100.0 | 85:15 |
| Crystalline polyester 14 | Sebacic acid | 35.0 | 1,12-Dodecanediol | 38.0 | Styrene | 100.0 | 60:40 |
| Crystalline polyester 15 | Sebacic acid | 450.0 | 1,12-Dodecanediol | 495.0 | Styrene | 100.0 | 90:10 |
| Crystalline polyester 16 | Sebacic acid | 100.0 | 1,12-Dodecanediol | 93.5 | Styrene/acrylic acid | 140.0/15.0 | 80:20 |
| Crystalline polyester 17 | Adipic acid | 129.0 | 1,6-Hexanediol | 115.0 | Styrene | 100.0 | 71:29 |
| Crystalline polyester 24 | Sebacic acid | 179.0 | Ethylene glycol | 60.0 | Styrene | 100.0 | 70:30 |

TABLE 3

| Crystalline polyester | Crystalline moiety: Acid monomer | Crystalline moiety: Alcohol monomer | Amorphous moiety | Ratio "crystalline moiety:amorphous moiety" | Mw | Tm (° C.) |
|---|---|---|---|---|---|---|
| Crystalline polyester 1 | Sebacic acid | 1,12-Dodecanediol | Styrene | 70:30 | 22,000 | 78 |
| Crystalline polyester 2 | 1,10-Decanedicarboxylic acid | 1,12-Dodecanediol | Styrene | 70:30 | 22,000 | 80 |
| Crystalline polyester 3 | Sebacic acid | 1,9-Nonanediol | — | — | 22,000 | 67 |
| Crystalline polyester 4 | Sebacic acid | 1,6-Hexanediol | Styrene | 69:31 | 22,000 | 78 |
| Crystalline polyester 5 | Suberic acid | 1,6-Hexanediol | Styrene | 69:31 | 22,000 | 54 |
| Crystalline polyester 6 | 1,10-Decanedicarboxylic acid | 1,10-Decanediol | Styrene | 69:31 | 22,000 | 72 |
| Crystalline polyester 7 | 1,12-Dodecanedicarboxylic acid | 1,12-Dodecanediol | Styrene | 70:30 | 22,000 | 87 |
| Crystalline polyester 8 | Sebacic acid | 1,12-Dodecanediol | Styrene | 70:30 | 11,000 | 78 |
| Crystalline polyester 9 | Sebacic acid | 1,12-Dodecanediol | Styrene | 70:30 | 45,000 | 78 |
| Crystalline polyester 10 | Sebacic acid | 1,12-Dodecanediol | Styrene | 70:30 | 8,000 | 78 |
| Crystalline polyester 11 | Sebacic acid | 1,12-Dodecanediol | Styrene | 70:30 | 55,000 | 78 |
| Crystalline polyester 12 | Sebacic acid | 1,12-Dodecanediol | Styrene | 55:45 | 26,000 | 75 |
| Crystalline polyester 13 | Sebacic acid | 1,12-Dodecanediol | Styrene | 85:15 | 21,000 | 80 |
| Crystalline polyester 14 | Sebacic acid | 1,12-Dodecanediol | Styrene | 60:40 | 27,000 | 72 |
| Crystalline polyester 15 | Sebacic acid | 1,12-Dodecanediol | Styrene | 90:10 | 21,000 | 81 |
| Crystalline polyester 16 | Sebacic acid | 1,12-Dodecanediol | Styrene | 80:20 | 35,000 | 78 |
| Crystalline polyester 17 | Adipic acid | 1,6-Hexanediol | Styrene | 71:29 | 22,000 | 50 |
| Crystalline polyester 18 | 1,10-Decanedicarboxylic acid | 1,10-Decanediol | TPA/BPA-PO/BPA-EO | 70:30 | 25,000 | 67 |
| Crystalline polyester 19 | 1,10-Decanedicarboxylic acid | 1,10-Decanediol | 4,4'-Diphenylmethane diisocyanate/BPA-PO/ethylene glycol | 70:30 | 25,000 | 69 |
| Crystalline polyester 20 | 1,10-Decanedicarboxylic acid | 1,10-Decanediol | TPA/BPA-PO/BPA-EO | 70:30 | 25,000 | 67 |
| Crystalline polyester 21 | 1,10-Decanedicarboxylic acid | 1,10-Decanediol | TPA/BPA-PO/BPA-EO | 70:30 | 55,000 | 67 |
| Crystalline polyester 22 | 1,10-Decanedicarboxylic acid | 1,10-Decanediol | TPA/BPA-PO/BPA-EO | 70:30 | 8,000 | 67 |
| Crystalline polyester 23 | 1,10-Decanedicarboxylic acid | 1,10-Decanediol | TPA/BPA-PO/BPA-EO | 40:60 | 35,000 | 67 |
| Crystalline polyester 24 | Sebacic acid | Ethylene glycol | Styrene | 90:10 | 2,0000 | 78 |

<Production Example of Toner Particles 1>

[Step of preparing Colorant Dispersion Liquid 1]

| | |
|---|---|
| Styrene monomer (ST) | 270 parts |
| n-Butyl acrylate (BA) monomer | 90 parts |
| Polar resin (copolymer of styrene, methacrylate, methyl methacrylate, and 2-hydroxyethyl methacrylate, Mw = 14,800, Tg = 89° C., Acid value AV = 22 mgKOH/g, Hydroxyl value OHv = 8 mgKOH/g) | 20 parts |
| Colorant 1 | 20 parts |
| Pigment Yellow 155 (PY155) | 16 parts |

(Toner Yellow 4G: Clariant)

The foregoing materials were introduced into an attritor (manufactured by Mitsui Mining Co., Ltd.), and were stirred with zirconia beads each having a radius of 2.5 mm (200 parts) at 200 rpm and 25° C. for 180 minutes to prepare a colorant dispersion liquid.

[Step of Preparing Toner Composition-Dissolved Liquid]

| | |
|---|---|
| Colorant dispersion liquid 1 | 312 parts |
| Crystalline polyester 1 | 15 parts |
| Hydrocarbon-based wax (Fischer-Tropsch wax; HNP-9) | 21 parts |
| Aluminum compound of 3,5-di-tertiary butyl salicylate [BONTRON E88 (manufactured by Orient Chemical Industries Co., Ltd.)] | 3 parts |

The foregoing materials were mixed and warmed to 65° C. The materials were uniformly dissolved and dispersed with a TK homomixer (manufactured by Tokushu Kika Kogyo Co., Ltd.) at 5,000 rpm for 60 minutes. Thus, a toner composition-dissolved liquid 1 was obtained.

[Step of Preparing Dispersion Liquid of Toner Particles 1]

900 Parts of ion-exchanged water, 150 parts of a 0.5 M aqueous solution of $Na_3PO_4$, and 6.5 parts of a 10% aqueous solution of hydrochloric acid were loaded into a 2-liter four-necked flask with a high-speed stirring apparatus TK homomixer. After that, the number of revolutions of the TK homomixer was adjusted to 12,000 rpm and the mixture was warmed to 60° C. After that, 6.5 parts of a 1.0 M aqueous solution of $CaCl_2$ was gradually added to the mixture. Thus, an aqueous medium containing a calcium phosphate compound was obtained.

Next, 25 parts of a 70% solution of a polymerization initiator 1,1,3,3-tetramethylbutylperoxy-2-ethylhexanoate in toluene was dissolved in the toner composition-dissolved liquid 1, and the contents were sufficiently mixed. Then, the mixture was loaded into the aqueous medium. The resultant was stirred at a temperature of 62° C. under a $N_2$ atmosphere with the TK homomixer at 12,000 rpm for 10 minutes. Thus, a polymerizable monomer composition was granulated. After that, while the resultant was stirred with a paddle stirring blade, its temperature was increased to 75° C. and the resultant was subjected to polymerization for 7.5 hours. Thus, a polymerization reaction was completed. Next, the remaining solvent was removed by distillation under reduced pressure, and the aqueous medium was cooled. Thus, a dispersion liquid of toner particles 1 was obtained. The weight-average particle diameter (D4) of the resultant toner particles 1 was 6.3 μm. In addition, the mass ratio of the colorant 1 (compound represented by the formula (1)) to the PY 155 (yellow pigment) was 56/44.

Hydrochloric acid was added to the dispersion liquid of the toner particles 1 to adjust its pH to 1.4, and the calcium phosphate salt was dissolved by stirring the mixture for 1 hour. The resultant was subjected to solid-liquid separation with a pressure filter under a pressure of 0.4 MPa to provide a toner cake. Next, ion-exchanged water was loaded into the pressure filter until the filter was full of the water, and then the cake was washed under a pressure of 0.4 MPa. The washing operation was repeated three times, and then the cake was dried to provide toner particles 1. Details about the toner particles 1 are shown in Table 4-1.

<Production Examples of Toner Particles 2 to 25, 38, and 39>

Toner particles 2 to 25, 38, and 39 were obtained in the same manner as in the production example of the toner particles 1 except that the composition of the toner particles 1 was changed as shown in Tables 4-1 and 4-2. In the toner particles 21, the mass ratio of the colorant 2 (compound represented by the formula (1)) to the PY 155 (yellow pigment) was 11/89.

<Production Example of Toner Particles 26>

[Step of Preparing Colorant Dispersion Liquid 2]

| | |
|---|---|
| Toluene | 350 parts |
| Colorant 3 | 44 parts |
| Pigment Yellow 155 (Toner Yellow 4G: Clariant) | 35 parts |
| Aluminum compound of 3,5-di-tertiary butyl salicylate [BONTRON E88 (manufactured by Orient Chemical Industries Co., Ltd.)] | 10 parts |

The foregoing materials were introduced into an attritor (manufactured by Mitsui Mining Co., Ltd.), and were stirred with zirconia beads each having a radius of 2.5 mm (200 parts) at 200 rpm and 25° C. for 180 minutes to prepare a colorant dispersion liquid 2.

[Step of preparing Toner Composition-Dissolved Liquid 2]

| | |
|---|---|
| Colorant dispersion liquid 2 | 250 parts |
| Polar resin (copolymer of styrene, methacrylate, methyl methacrylate, and 2-hydroxyethyl methacrylate, Mw = 14,800, Tg = 89° C., Acid value AV = 22 mgKOH/g, Hydroxyl value OHv = 8 mgKOH/g) | 25 parts |

-continued

| | |
|---|---|
| Styrene-acrylic resin (copolymer of styrene:n-butyl acrylate = 75:25 (mass ratio)) (Mw = 30,000, Tg = 55° C.) | 450 parts |
| Crystalline polyester 1 | 25 parts |
| Hydrocarbon-based wax (Fischer-Tropsch wax; HNP-9) | 35 parts |

The foregoing materials were mixed and warmed to 65° C. The materials were uniformly dissolved and dispersed with a TK homomixer (manufactured by Tokushu Kika Kogyo Co., Ltd.) at 5,000 rpm for 60 minutes. Thus, a toner composition-dissolved liquid 2 was obtained.

[Step of preparing Toner Particle Dispersion Liquid 2]

1,200 Parts of ion-exchanged water and 300 parts of a 0.5 M aqueous solution of $Na_3PO_4$ were loaded into a 2-liter four-necked flask with a high-speed stirring apparatus TK homomixer. After that, the number of revolutions of the TK homomixer was adjusted to 12,000 rpm and the mixture was warmed to 60° C. After that, 25.7 parts of a 1.0 M aqueous solution of $CaCl_2$ was gradually added to the mixture. Thus, an aqueous medium containing a calcium phosphate compound was obtained.

Next, the toner composition-dissolved liquid 2 was loaded into the aqueous medium. The mixture was stirred at a temperature of 65° C. under a $N_2$ atmosphere with the TK homomixer at 12,000 rpm for 30 minutes. Thus, the particles of the toner composition-dissolved liquid 2 were produced. Next, the remaining solvent was removed by distillation under reduced pressure, and the aqueous medium was cooled. Thus, a toner particle dispersion liquid 2 was obtained. The weight-average particle diameter (D4) of the resultant toner particles was 6.8 μm.

Hydrochloric acid was added to the toner particle dispersion liquid 2 to adjust its pH to 1.4, and the calcium phosphate salt was dissolved by stirring the mixture for 1 hour. The resultant was subjected to solid-liquid separation with a pressure filter under a pressure of 0.4 MPa to provide a toner cake. Next, ion-exchanged water was loaded into the pressure filter until the filter was full of the water, and then the cake was washed under a pressure of 0.4 MPa. The washing operation was repeated three times, and then the cake was dried to provide toner particles 26. The toner particle composition of the toner particles 26 is shown in Table 4-1.

<Production Examples of Toner Particles 29, and 34 to 37>

Toner particles 29, and 34 to 37 were obtained in the same manner as in the production example of the toner particles 26 except that the raw materials of the toner particles 26 were changed as shown in Tables 4-1 and 4-2.

<Production Example of Toner Particles 27>

| | |
|---|---|
| Styrene-acrylic resin (copolymer of styrene:n-butyl acrylate = 75:25 (mass ratio)) (Mw = 30,000, Tg = 55° C.) | 95.0 parts |
| Crystalline polyester 1 | 5.0 parts |
| Colorant 1 | 5.0 parts |
| Colorant 4 | 4.0 parts |
| Aluminum compound of 3,5-di-tertiary butyl salicylate [BONTRON E88 (manufactured by Orient Chemical Industries Co., Ltd.)] | 1.0 part |
| Hydrocarbon-based wax (Fischer-Tropsch wax; HNP-9) | 5.0 parts |

Materials according to the foregoing formulation were sufficiently mixed with a Henschel mixer. After that, the mixture was kneaded with a biaxial kneader set to a temperature of 130° C. The resultant kneaded product was cooled and coarsely pulverized with a hammer mill to 2 mm or less. Thus, a coarsely pulverized product was obtained.

The resultant coarsely pulverized product was moderately pulverized to a weight-average particle diameter of 100 μm with ACM10 manufactured by Hosokawa Micron Corporation, and the resultant moderately pulverized product was finely pulverized with a mechanical pulverizer (manufactured by Turbo Kogyo Co., Ltd.; TURBOMILL Model T250-RS). After that, the resultant finely pulverized product was subjected to coarse particle classification with TURBOPLEX 100 ATP manufactured by Hosokawa Micron Corporation to provide toner particles 27. The weight-average particle diameter (D4) of the resultant toner particles was 6.7 μm. Details about the toner particles 27 are shown in Table 4-1.

<Production Examples of Toner Particles 28, and 30 to 33>

Toner particles 28, and 30 to 33 were obtained in the same manner as in the production example of the toner particles 27 except that the composition of the toner particles 27 was changed as shown in Tables 4-1 and 4-2.

<Production Examples of Comparative Toner Particles 1 to 3>

Comparative toner particles 1 to 3 were obtained in the same manner as in the production example of the toner particles 1 except that the composition of the toner particles 1 was changed as shown in Table 4-2.

TABLE 4-1

| | | Resin component | | | | | | Particle | |
|---|---|---|---|---|---|---|---|---|---|
| | | Binder resin | | Crystalline resin | | Colorant | | diameter | |
| | Production method | Kind | Composition ratio* | Kind | Composition ratio* | Kind | Composition ratio* | D4 (μm) | ΔSP |
| Toner particles 1 | Suspension polymerization | St/BA/polar resin | 67.5/22.5/5.0 | Crystalline polyester 1 | 5.0 | Colorant 1/ PY155 | 5.0/4.0 | 6.4 | 0.28 |
| Toner particles 2 | Suspension polymerization | St/BA/polar resin | 67.5/22.5/5.0 | Crystalline polyester 2 | 5.0 | Colorant 1/ PY155 | 5.0/4.0 | 6.0 | 0.36 |
| Toner particles 3 | Suspension polymerization | St/BA/polar resin | 67.5/22.5/5.0 | Crystalline polyester 3 | 5.0 | Colorant 1/ PY155 | 5.0/4.0 | 6.1 | 0.29 |
| Toner particles 4 | Suspension polymerization | St/BA/polar resin | 70.5/23.5/5.0 | Crystalline polyester 1 | 1.0 | Colorant 2/ PY155 | 5.0/4.0 | 6.0 | 0.28 |
| Toner particles 5 | Suspension polymerization | St/BA/polar resin | 48.8/16.2/5.0 | Crystalline polyester 4 | 30.0 | Colorant 2/ PY155 | 5.0/4.0 | 6.2 | 0.28 |
| Toner particles 6 | Suspension polymerization | St/BA/polar resin | 45.0/15.0/5.0 | Crystalline polyester 4 | 35.0 | Colorant 2/ PY155 | 5.0/4.0 | 6.0 | 0.2 |
| Toner particles 7 | Suspension polymerization | St/BA/polar resin | 67.5/22.5/5.0 | Crystalline polyester 5 | 5.0 | Colorant 1/ PY155 | 5.0/4.0 | 6.3 | 0.05 |
| Toner particles 8 | Suspension polymerization | St/BA/polar resin | 67.5/22.5/5.0 | Crystalline polyester 6 | 5.0 | Colorant 1/ PY155 | 5.0/4.0 | 6.4 | 0.28 |
| Toner particles 9 | Suspension polymerization | St/BA/polar resin | 67.5/22.5/5.0 | Crystalline polyester 7 | 5.0 | Colorant 1/ PY155 | 5.0/4.0 | 6.1 | 0.38 |
| Toner particles 10 | Suspension polymerization | St/BA/polar resin | 67.5/22.5/5.0 | Crystalline polyester 2 | 5.0 | Colorant 1/ PY155 | 5.0/4.0 | 6.2 | 0.36 |
| Toner particles 11 | Suspension polymerization | St/BA/polar resin | 63.8/21.2/5.0 | Crystalline polyester 8 | 10.0 | Colorant 1/ PY155 | 5.0/4.0 | 6.0 | 0.28 |
| Toner particles 12 | Suspension polymerization | St/BA/polar resin | 63.8/21.2/5.0 | Crystalline polyester 9 | 10.0 | Colorant 1/ PY155 | 5.0/4.0 | 6.1 | 0.28 |
| Toner particles 13 | Suspension polymerization | St/BA/polar resin | 63.8/21.2/5.0 | Crystalline polyester 10 | 10.0 | Colorant 1/ PY155 | 5.0/4.0 | 6.1 | 0.28 |
| Toner particles 14 | Suspension polymerization | St/BA/polar resin | 63.8/21.2/5.0 | Crystalline polyester 11 | 10.0 | Colorant 1/ PY155 | 5.0/4.0 | 6.3 | 0.28 |
| Toner particles 15 | Suspension polymerization | St/BA/polar resin | 67.5/22.5/5.0 | Crystalline polyester 12 | 5.0 | Colorant 1/ PY155 | 5.0/4.0 | 6.1 | 0.26 |
| Toner particles 16 | Suspension polymerization | St/BA/polar resin | 67.5/22.5/5.0 | Crystalline polyester 13 | 5.0 | Colorant 1/ PY155 | 5.0/4.0 | 6.2 | 0.3 |
| Toner particles 17 | Suspension polymerization | St/BA/polar resin | 67.5/22.5/5.0 | Crystalline polyester 14 | 5.0 | Colorant 1/ PY155 | 5.0/4.0 | 6.3 | 0.24 |
| Toner particles 18 | Suspension polymerization | St/BA/polar resin | 67.5/22.5/5.0 | Crystalline polyester 15 | 5.0 | Colorant 1/ PY155 | 5.0/4.0 | 6.3 | 0.34 |
| Toner particles 19 | Suspension polymerization | St/BA/polar resin | 67.5/22.5/5.0 | Crystalline polyester 16 | 5.0 | Colorant 1/ PY155 | 5.0/4.0 | 6.0 | 0.31 |
| Toner particles 20 | Suspension polymerization | St/BA/polar resin | 67.5/22.5/5.0 | Crystalline polyester 17 | 5.0 | Colorant 1/ PY155 | 5.0/4.0 | 6.1 | 0.1 |
| Toner particles 21 | Suspension polymerization | St/BA/polar resin | 67.5/22.5/5.0 | Crystalline polyester 1 | 5.0 | Colorant 2/ PY155 | 1.0/8.0 | 6.2 | 0.28 |

TABLE 4-1-continued

| | | Resin component | | | | | | Particle | |
|---|---|---|---|---|---|---|---|---|---|
| | | Binder resin | | Crystalline resin | | Colorant | | diameter | |
| | Production method | Kind | Composition ratio* | Kind | Composition ratio* | Kind | Composition ratio* | D4 (μm) | ΔSP |
| Toner particles 22 | Suspension polymerization | St/BA/polar resin | 67.5/22.5/5.0 | Crystalline polyester 1 | 5.0 | Colorant 2 | 10.0 | 6.1 | 0.28 |
| Toner particles 23 | Suspension polymerization | St/BA/polar resin | 67.5/22.5/5.0 | Crystalline polyester 1 | 5.0 | Colorant 2 | 15.0 | 6.1 | 0.28 |
| Toner particles 24 | Suspension polymerization | St/BA/polar resin | 67.5/22.5/5.0 | Crystalline polyester 1 | 5.0 | Colorant 3/ PY155 | 5.0/4.0 | 6.3 | 0.28 |
| Toner particles 25 | Suspension polymerization | St/BA/polar resin | 67.5/22.5/5.0 | Crystalline polyester 1 | 5.0 | Colorant 2/ PY155 | 5.0/4.0 | 6.4 | 0.28 |
| Toner particles 26 | Dissolution suspension | Styrene-acrylic resin/polar resin | 90.0/5.0 | Crystalline polyester 1 | 5.0 | Colorant 3/ PY155 | 5.0/4.0 | 6.5 | 0.28 |
| Toner particles 27 | Melting kneading | Styrene-acrylic resin | 95.0 | Crystalline polyester 1 | 5.0 | Colorant 1/ Colorant 4 | 5.0/4.0 | 6.5 | 0.28 |
| Toner particles 28 | Melting kneading | Amorphous polyester A | 95.0 | Crystalline polyester 18 | 5.0 | Colorant 3/ PY155 | 5.0/4.0 | 6.7 | 0.19 |
| Toner particles 29 | Dissolution suspension | Amorphous polyester A | 95.0 | Crystalline polyester 19 | 5.0 | Colorant 3/ PY155 | 5.0/4.0 | 6.6 | 0.3 |

TABLE 4-2

| | | Resin component | | | | | | Particle | |
|---|---|---|---|---|---|---|---|---|---|
| | | Binder resin | | Crystalline resin | | Colorant | | diameter | |
| | Production method | Kind | Composition ratio* | Kind | Composition ratio* | Kind | Composition ratio* | D4 (μm) | ΔSP |
| Toner particles 30 | Melting kneading | Amorphous polyester A | 95.0 | Crystalline polyester 18 | 5.0 | Colorant 3/ PY155 | 5.0/4.0 | 6.7 | 0.41 |
| Toner particles 31 | Melting kneading | Amorphous polyester A | 95.0 | Crystalline polyester 18 | 0.5 | Colorant 3/ PY155 | 5.0/4.0 | 6.5 | 0.19 |
| Toner particles 32 | Melting kneading | Amorphous polyester A | 95.0 | Crystalline polyester 19 | 35.0 | Colorant 3/ PY155 | 5.0/4.0 | 6.5 | 0.3 |
| Toner particles 33 | Melting kneading | Amorphous polyester A | 95.0 | Crystalline polyester 18 | 5.0 | Colorant 1 | 15.0 | 6.6 | 0.19 |
| Toner particles 34 | Dissolution suspension | Amorphous polyester A | 95.0 | Crystalline polyester 20 | 5.0 | Colorant 1/ PY155 | 5.0/4.0 | 6.5 | 0.19 |
| Toner particles 35 | Dissolution suspension | Amorphous polyester A | 95.0 | Crystalline polyester 21 | 5.0 | Colorant 1/ PY155 | 5.0/4.0 | 6.4 | 0.19 |
| Toner particles 36 | Dissolution suspension | Amorphous polyester A | 95.0 | Crystalline polyester 22 | 5.0 | Colorant 1/ PY155 | 5.0/4.0 | 6.5 | 0.19 |
| Toner particles 37 | Dissolution suspension | Amorphous polyester A | 95.0 | Crystalline polyester 23 | 5.0 | Colorant 1/ PY155 | 5.0/4.0 | 6.7 | 0.19 |
| Toner particles 38 | Suspension polymerization | St/BA/polar resin | 67.5/22.5/5.0 | Crystalline polyester 1 | 5.0 | Colorant 4/ PY155 | 5.0/4.0 | 6.5 | 0.28 |
| Toner particles 39 | Suspension polymerization | St/BA/polar resin | 67.5/22.5/5.0 | Crystalline polyester 1 | 5.0 | Colorant 5/ PY155 | 5.0/4.0 | 6.4 | 0.28 |
| Comparative Toner particles 1 | Suspension polymerization | St/BA/polar resin | 63.8/21.2/5.0 | Crystalline polyester 24 | 10.0 | Colorant 3/ PY155 | 5.0/4.0 | 6.2 | 0.55 |
| Comparative Toner particles 2 | Suspension polymerization | St/BA/polar resin | 71.3/23.7/5.0 | — | — | Colorant 3/ PY155 | 5.0/4.0 | 6.3 | — |

TABLE 4-2-continued

| | | Resin component | | | | | | Particle | |
|---|---|---|---|---|---|---|---|---|---|
| | | Binder resin | | Crystalline resin | | Colorant | | diameter | |
| | Production method | Kind | Composition ratio* | Kind | Composition ratio* | Kind | Composition ratio* | D4 (μm) | ΔSP |
| Comparative Toner particles 3 | Suspension polymerization | St/BA/polar resin | 63.8/21.2/5.0 | Crystalline polyester 1 | 10.0 | PY155 | 8.0 | 6.2 | 0.28 |

*Each composition ratio was calculated based on the total of resin components defined as 100.

Coloring power and light fastness were evaluated in accordance with the following evaluation methods.

<Output of Evaluation Image>

1.5 Parts of a hydrophobic silica fine powder subjected to a surface treatment with hexamethyldisilazane (number-average primary particle diameter: 10 nm) was added to 100 parts of test toner particles, and the contents were subjected to a mixing step with a Henschel mixer (manufactured by Mitsui Mining Co., Ltd.) for 300 seconds to provide a test toner (yellow toner).

A toner stored in a cartridge for a commercial color laser printer Satera LBP7700C (manufactured by Canon Inc.) was removed from the cartridge, and the inside of the cartridge was cleaned by air blowing. After that, the test toner (150 g) was loaded into the cartridge. In addition, the Satera LBP7700C (manufactured by Canon Inc.) was partially reconstructed as follows: the printer was changed so as to be capable of outputting an unfixed image by removing its fixing machine, and was made capable of regulating an image density with its controller. Further, the printer was reconstructed so as to operate even when only a process cartridge for one color was mounted thereon. The cartridge was mounted on the printer, the controller was set so that a toner laid-on level became 0.30 mg/cm$^2$, and a rectangular solid image measuring 6.5 cm by 14.0 cm was output at the center of a transfer material. The image was defined as an evaluation image. Letter size HP LASERJET PAPER (manufactured by Hewlett-Packard Company, 90.0 g/m$^2$) was used as the transfer material.

<Method of Evaluating Coloring Power>

Coloring power was evaluated by measuring an image density in the evaluation image. The image density was measured with "X-Rite color reflection densitometer (color reflection densitometer X-Rite 404A)." The density of the solid image portion relative to a white ground portion having an original density of 0.00 was measured. Densities at five points of the solid image portion, i.e., its upper right, upper left, center, lower right, and lower left were measured, and the average of the measured values was evaluated as an image density. Evaluation criteria are as described below.

A: The image density is 1.60 or more and hence the coloring power is extremely excellent.

B: The image density is 1.50 or more and less than 1.60, and hence the coloring power is excellent.

C: The image density is 1.40 or more and less than 1.50, and hence the coloring power is satisfactory.

D: The image density is less than 1.40 and hence the coloring power is poor.

<Method of Evaluating Light Fastness>

The evaluation image was irradiated with light having an intensity of 80,000 (lux) for 300 hours in a super fluorescent lamp FADE METER FL (manufactured by Suga Test Instruments Co., Ltd.), and the residual ratio of its image density after the light irradiation to that before the light irradiation was determined. Light fastness was evaluated from a value for the residual ratio based on the following evaluation criteria. The image densities were measured as in the coloring power.

A: The image density residual ratio is 90% or more and hence the light fastness is extremely excellent.

B: The image density residual ratio is 85% or more and less than 90%, and hence the light fastness is excellent.

C: The image density residual ratio is 75% or more and less than 85%, and hence the light fastness is satisfactory.

D: The image density residual ratio is less than 75% and hence the light fastness is poor.

Examples 1 to 39

In each of Examples 1 to 39, coloring power and light fastness were evaluated by using each of the toner particles 1 to 39 (yellow toners) as a toner. The results of the evaluations are shown in Table 5.

Comparative Examples 1 to 3

In each of Comparative Examples, coloring power and light fastness were evaluated by using each of the comparative toner particles 1 to 3. The results of the evaluations are shown in Table 5.

TABLE 5

| | | Evaluation | | | |
|---|---|---|---|---|---|
| | | Coloring power | | Light fastness | |
| Example | Toner | Measured value | Rank | Measured value | Rank |
| Example 1 | Toner particles 1 | 1.67 | A | 95 | A |
| Example 2 | Toner particles 2 | 1.66 | A | 92 | A |
| Example 3 | Toner particles 3 | 1.63 | A | 81 | C |
| Example 4 | Toner particles 4 | 1.62 | A | 88 | B |
| Example 5 | Toner particles 5 | 1.65 | A | 86 | B |
| Example 6 | Toner particles 6 | 1.64 | A | 83 | C |
| Example 7 | Toner particles 7 | 1.65 | A | 90 | A |
| Example 8 | Toner particles 8 | 1.64 | A | 91 | A |
| Example 9 | Toner particles 9 | 1.66 | A | 78 | C |
| Example 10 | Toner particles 10 | 1.65 | A | 83 | C |
| Example 11 | Toner particles 11 | 1.65 | A | 91 | A |
| Example 12 | Toner particles 12 | 1.65 | A | 91 | A |
| Example 13 | Toner particles 13 | 1.65 | A | 88 | B |
| Example 14 | Toner particles 14 | 1.65 | A | 85 | B |
| Example 15 | Toner particles 15 | 1.65 | A | 91 | A |
| Example 16 | Toner particles 16 | 1.65 | A | 90 | A |
| Example 17 | Toner particles 17 | 1.65 | A | 87 | B |
| Example 18 | Toner particles 18 | 1.64 | A | 86 | B |
| Example 19 | Toner particles 19 | 1.63 | A | 88 | B |
| Example 20 | Toner particles 20 | 1.64 | A | 90 | A |
| Example 21 | Toner particles 21 | 1.55 | B | 98 | A |
| Example 22 | Toner particles 22 | 1.72 | A | 82 | C |
| Example 23 | Toner particles 23 | 1.74 | A | 81 | C |

TABLE 5-continued

| Example | Toner | Evaluation: Coloring power Measured value | Coloring power Rank | Light fastness Measured value | Light fastness Rank |
|---|---|---|---|---|---|
| Example 24 | Toner particles 24 | 1.65 | A | 90 | A |
| Example 25 | Toner particles 25 | 1.65 | A | 97 | A |
| Example 26 | Toner particles 26 | 1.65 | A | 95 | A |
| Example 27 | Toner particles 27 | 1.65 | A | 95 | A |
| Example 28 | Toner particles 28 | 1.65 | A | 95 | A |
| Example 29 | Toner particles 29 | 1.65 | A | 95 | A |
| Example 30 | Toner particles 30 | 1.65 | A | 88 | B |
| Example 31 | Toner particles 31 | 1.65 | A | 89 | B |
| Example 32 | Toner particles 32 | 1.49 | C | 96 | A |
| Example 33 | Toner particles 33 | 1.75 | A | 77 | C |
| Example 34 | Toner particles 34 | 1.65 | A | 85 | B |
| Example 35 | Toner particles 35 | 1.65 | A | 88 | B |
| Example 36 | Toner particles 36 | 1.65 | A | 85 | B |
| Example 37 | Toner particles 37 | 1.65 | A | 84 | C |
| Example 38 | Toner particles 38 | 1.53 | B | 95 | A |
| Example 39 | Toner particles 39 | 1.52 | B | 95 | A |
| Comparative Example 1 | Comparative Toner particles 1 | 1.65 | A | 72 | D |
| Comparative Example 2 | Comparative Toner particles 2 | 1.68 | A | 68 | D |
| Comparative Example 3 | Comparative Toner particles 3 | 1.38 | D | 98 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107589, filed May 27, 2015, which is hereby incorporated by reference herein in its entirety.

What is claimed is:

1. A toner, comprising a toner particle comprising:

a binder resin selected from the group consisting of a styrene vinyl resin, a maleic acid copolymer, a polyester resin, an epoxy resin, or polyurethane resin, and having a solubility parameter SP1 according to the equation of Fedors;

a crystalline polyester having a crystalline polyester moiety and an amorphous moiety, said crystalline polyester having a solubility parameter SP2 according to the equation of Fedors; and a colorant, wherein $\Delta SP=|SP1-SP2|\leq 0.43$, and the colorant comprises a compound represented by formula (1)

(1)

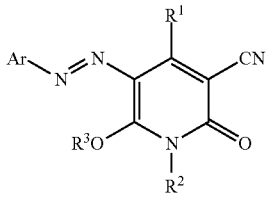

where $R^1$, $R^2$, and $R^3$ each independently represent a hydrogen atom or an alkyl group having 1 to 5 carbon atoms, and Ar represents a substituted or unsubstituted aryl group, or a substituted or unsubstituted heteroaryl group.

2. A toner according to claim 1, wherein the crystalline polyester moiety has a structural unit represented by formula (4):

(4)

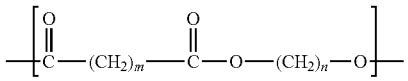

where m represents an integer of from 4 to 10, and n represents an integer of from 4 to 12.

3. A toner according to claim 1, wherein the amorphous moiety is one of a polystyrene, a polyester, or a polyurethane.

4. A toner according to claim 3, wherein the amorphous moiety is polystyrene and the binder resin is a styrene vinyl resin.

5. A toner according to claim 3, wherein the crystalline polyester is a block polymer having the crystalline polyester moiety and the amorphous moiety that comprises the polystyrene, and the crystalline polyester moiety has a unit derived from a divalent acid monomer represented by formula (5) and a unit derived from a dihydric alcohol monomer represented by formula (6):

$$HOOC—(CH_2)_m—COOH \quad (5)$$

$$HO—(CH_2)_n—OH \quad (6)$$

where in formula (5), m represents an integer of from 4 to 10, and in formula (6), n represents an integer of from 4 to 12.

6. A toner according to claim 3, wherein the amorphous moiety is one of polyester and polyurethane, and the binder resin is a polyester resin.

7. A toner according to claim 6, wherein the amorphous moiety is polyester.

8. A toner according to claim 1, wherein a mass ratio of the crystalline polyester moiety to the amorphous moiety in the crystalline polyester is 50/50 to 95/5.

9. A toner according to claim 1, wherein a content of the crystalline polyester is 0.5 to 30 mass % with respect to a total amount of the binder resin and the crystalline polyester.

10. A toner according to claim 1, wherein the crystalline polyester has a weight-average molecular weight (Mw) of 10,000 to 50,000.

11. A toner according to claim 1, wherein the crystalline polyester has a melting point of 50 to 90° C.

12. A toner according to claim 1, wherein a content of the compound represented by formula (1) is 0.5 to 10.0 mass % with respect to a total amount of the binder resin and the crystalline polyester.

13. A toner according to claim 1, wherein the colorant further contains a yellow pigment.

14. A toner according to claim 13, wherein a mass ratio of the compound represented by formula (1) to the yellow pigment is 7/93 to 65/35.

15. A toner according to claim 1, wherein the compound represented by formula (1) is a compound represented by formula (3):

Formula (3)
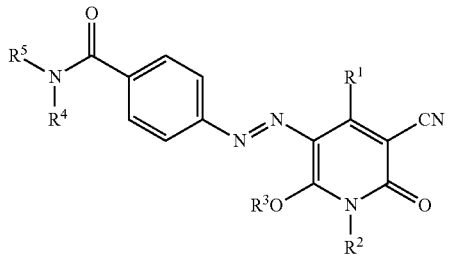
where $R^1$, $R^2$, and $R^3$ each independently represent a hydrogen atom or an alkyl group having 1 to 5 carbon atoms, and $R^4$ and $R^5$ each independently represent a hydrogen atom or an alkyl group having 1 to 12 carbon atoms.
16. A toner according to claim 1, wherein the binder resin is a styrene vinyl resin, or polyester resin.
* * * * *